US008495805B2

(12) United States Patent
Reutter et al.

(10) Patent No.: US 8,495,805 B2
(45) Date of Patent: Jul. 30, 2013

(54) APPARATUS FOR NEEDLING A FIBROUS WEB

(75) Inventors: Tilman Reutter, Eidenberg (AT); Andreas Plump, Linz (AT); Andreas Mayer, Linz (AT); Daniel Bu, Ansfelden (AT)

(73) Assignee: Hi Tech Textile Holding GmbH, Leonding (AT)

( * ) Notice: Subject to any disclaimer, the term of this patent is extended or adjusted under 35 U.S.C. 154(b) by 196 days.

(21) Appl. No.: 12/937,841

(22) PCT Filed: Apr. 1, 2009

(86) PCT No.: PCT/EP2009/053894

§ 371 (c)(1), (2), (4) Date: Jan. 7, 2011

(87) PCT Pub. No.: WO2009/127520

PCT Pub. Date: Oct. 22, 2009

(65) Prior Publication Data

US 2011/0179611 A1 Jul. 28, 2011

(30) Foreign Application Priority Data

Apr. 17, 2008 (DE) ..... 10 2008 019 217

(51) Int. Cl.
*D04H 18/00* (2012.01)

(52) U.S. Cl.
USPC ..... 28/114

(58) Field of Classification Search
USPC ..... 28/107, 109, 110, 111, 113, 114, 28/115; 112/80.41, 80.42, 80.43
See application file for complete search history.

(56) References Cited

U.S. PATENT DOCUMENTS 5,502,879 A * 4/1996 Rinder ..... 28/115
5,511,294 A * 4/1996 Fehrer ..... 28/113
5,548,881 A 8/1996 Ludwig (Continued)

FOREIGN PATENT DOCUMENTS

CN 1414160 A 4/2003
DE 10240370 A1 4/2003

(Continued)

OTHER PUBLICATIONS

International Search Report for International Application No. PCT/EP2009/053894.

(Continued)

*Primary Examiner* — Amy Vanatta
(74) *Attorney, Agent, or Firm* — Alston & Bird LLP

(57) ABSTRACT

An apparatus is described for needling a fibrous web having at least one needle bar. On its underside, the needle bar carries a needle board with a multiplicity of needles, wherein the needle bar is guided via a movably held bar carrier. The bar carrier is driven in an oscillating manner with a superimposed horizontal and vertical movement by a crank mechanism drive. To this end, a phase shifting device is provided, by which the crankshafts of the crank mechanism drive can be adjusted depending on the phase relation. Here, the movement of the bar carrier is guided by a guide device. In order to obtain stable guidance with high flexibility in every situation, according to the invention the guide device is formed by a steering rod which is connected at one end to the bar carrier by a rotary joint and which is coupled with the other end to a steering gear by a second rotary joint.

13 Claims, 2 Drawing Sheets

U.S. PATENT DOCUMENTS

| | | | | |
|---|---|---|---|---|
| 5,568,678 | A * | 10/1996 | Fehrer | 28/115 |
| 5,732,453 | A | 3/1998 | Dilo et al. | |
| 6,161,269 | A | 12/2000 | Dilo et al. | |
| 6,266,856 | B1 * | 7/2001 | Fehrer et al. | 28/107 |
| 6,481,071 | B1 * | 11/2002 | Fehrer et al. | 28/107 |
| 6,568,051 | B2 | 5/2003 | Legl et al. | |
| 2002/0162203 | A1 | 11/2002 | Legl et al. | |
| 2003/0041424 | A1 * | 3/2003 | Legl et al. | 28/107 |
| 2003/0056347 | A1 * | 3/2003 | Pum | 28/107 |
| 2005/0217093 | A1 | 10/2005 | Muller | |
| 2006/0288548 | A1 * | 12/2006 | Jean et al. | 28/107 |
| 2007/0006432 | A1 * | 1/2007 | Noel et al. | 28/107 |
| 2009/0119894 | A1 | 5/2009 | Reutter et al. | |
| 2010/0242240 | A1 * | 9/2010 | Reutter et al. | 28/107 |
| 2010/0306978 | A1 * | 12/2010 | Reutter et al. | 28/107 |

FOREIGN PATENT DOCUMENTS

| | | |
|---|---|---|
| EP | 1 939 343 | 7/2008 |
| WO | WO 2007/134731 | * 11/2007 |
| WO | WO 2009/019111 | 2/2009 |

OTHER PUBLICATIONS

International Preliminary Report on Patentability for International Application No. PCT/EP2009/053894, issued Nov. 9, 2010.

* cited by examiner

APPARATUS FOR NEEDLING A FIBROUS WEB

BACKGROUND OF THE INVENTION

Field of the Invention

The present invention relates to a device for needling a fibrous.

Description of Related Art

A device of the generic kind is disclosed in DE 10 2005 012 265 A1.

The device disclosed therein is used for strengthening and structuring fibrous layers. For this purpose, a fibrous web is pierced with a plurality of needles guided in an oscillating movement. During this process, the needles are guided with an oscillating vertical movement in order to strengthen the fibrous material contained in the fibrous web. During this process, the fibrous web is continuously moved forward by means of an advancing motion preferably carried out by means of rollers. Since the needles are not smooth but are provided with barbed hooks that are open in the piercing direction, individual fibers of the fibrous web are caught and realigned within the fibrous layers when the needles pierce the latter. This results in the desired fiber-mingling and bonding effects within the fibrous web. In order to prevent any undesirable deformations resulting, for example, in a draft of or slots in the needled fibrous material due to the advance of the fibrous web when the needles pierce the latter, the needles are guided in a horizontal movement that is superimposed on the vertical movement.

In the device disclosed in the aforementioned document, both the vertical and the horizontal movements of the needle beam are initiated by means of a crank mechanism drive. For this purpose, the crank mechanism drive comprises two crank drives having two driven crankshafts. By means of a phase-adjusting device, the crankshafts are formed so as to be adjustable in terms of their phase positions. Depending on the phase position of the crankshafts relative to each other, there thus results an ellipsoidal movement pattern, in which an oscillating movement of the needle beam is carried out.

In order to achieve the most stable possible piercing action of the needles into the fibrous web, a guiding device is additionally provided that engages the needle beam. However, in doing so, it is necessary to carry out the vertical and horizontal movements of the needle beam without any obstruction. In the device disclosed in the aforementioned document, the guiding device is formed by a guide rod that is guided on a guide bushing held on a machine frame. The guide bushing is held on the machine frame so as to be pivotable by means of a pivot bearing so that an inclined position of the beam carrier is possible by means of the pivot bearing of the guiding device depending on the phase position of the crankshafts. Depending on the degree of phase adjustment, there thus result various inclined positions of the beam carrier each of which leads to a horizontal movement with a defined stroke. The guide track of the beam carrier is determined by the fixed position of the pivot bearing of the guiding device. Thus, only relatively small horizontal strokes can be carried out since otherwise an excessive inclination of the beam carrier is achieved.

In principle, devices are also disclosed in the prior art in which the vertical movement of the needle beam is carried out by means of a vertical drive and the horizontal movement is carried out by means of a separate horizontal drive. Such a device is disclosed in DE 197 30 532 A1 by way of example. The separate horizontal drive of the device disclosed therein indeed enables larger amplitudes of motion in the horizontal direction, but suffers from the shortcoming of complicated mechanics resulting in insufficient stability and insufficient guidance of the needle beam, particularly at higher throughput speeds.

It is therefore the object of the invention to develop a device for needling a fibrous web of the generic kind such that the superimposed vertical and horizontal movements of the needle beam that are produced by a crank mechanism drive can be carried out with flexible adjustments in amplitudes of motion and stable guidance of the needle beam.

SUMMARY OF VARIOUS EMBODIMENTS

This object is achieved according to the invention by means of a device for needling a fibrous web in that the guiding device comprises a steering rod, one end of which is connected to the beam carrier by means of a swivel joint and the other end of which is coupled to a steering transmission by means of a second swivel joint.

Preferred developments of the invention are defined by the features and combinations of features described herein.

One particular advantage of the invention is that the beam carrier is linked to the machine frame by means of a steering transmission acting directly upon the beam carrier by means of a steering rod. Predetermined guide tracks for the steering rod can be produced by interposing the steering transmission, and these guide tracks are adapted to match the requirements of the needling process. Depending on the orientation of the steering rod, shear tensile forces can be absorbed both in the vertical and horizontal directions so that a stable guidance of the beam carrier is possible. Particularly, the pivot point on the beam carrier provides the beam carrier with a high degree of freedom to accommodate arbitrary phase adjustments of the crankshafts.

In order to considerably increase the range for adjusting a horizontal stroke, a development of the invention is particularly advantageous in which one of the transmission elements is formed as a drivable eccentric shaft that is mounted in the frame-rotary bearing and that is coupled to the steering rod by means of a connecting rod. Thus, in the case of an equiphase drive of the crankshafts, a horizontal stroke of the beam carrier can be initiated at a constant amount corresponding to the eccentricity of the eccentric shaft. This horizontal stroke can be increased or decreased by means of a phase adjustment of the crankshafts. It is thus possible to carry out relatively large horizontal strokes and thus high throughput speeds. The possible adjusting range of the horizontal stroke is doubled as a result.

Depending on the design of the steering transmission for guiding the steering rod, it is possible to implement a variety of guide tracks of the beam carrier. In a first variant, at least one of the transmission elements is formed as a rocker arm, the central portion of which is held on the machine frame by means of a rocker bearing. One end of the rocker arm is connected to the steering rod by means of a swivel joint and the opposite end of the rocker arm is connected to the connecting rod of the eccentric shaft by means of a second swivel joint. The guide track of the beam carrier produced by the steering rod can be formed so as to be straight depending on the adjustment of the lengths of the steering rod and the rocker arm.

Alternatively, it is also possible to form the connection of the steering rod by means of a rocker that is connected to the machine frame by means of a rotary bearing. The steering rod can thus be guided by means of the rocker and the connecting rod of the eccentric shaft.

In order to improve the guiding stability of the beam carrier, the steering rod is preferably connected to the center of the beam carrier by means of the swivel joint disposed on the beam carrier. The vertical and horizontal movements of the beam carrier can thus be transferred to the steering rod in a secure and stable manner.

In order to increase the flexibility in adjusting the horizontal strokes, particularly at varying throughput speeds of the fibrous web, the phase-adjusting device in a preferred development of the invention comprises two actuators that are assigned to the crankshafts of the crank drives and that can be controlled independently of each other by means of a control device. Thus, for example, in the case of a change of material, the machine settings can be adjusted rapidly and precisely to new specifications.

In principle, the phase-adjusting device can also be formed by a mechanical or hydraulic transmission system. The adjustment of the crankshafts can thus also be controlled by means of an actuator, for example.

The crankshafts can be adjusted both during operation when the shafts are being driven and when the shafts are idle. Thus other design solutions of the phase-adjusting device can also be utilized depending on the type of crankshaft adjustment.

BRIEF DESCRIPTION OF THE SEVERAL VIEWS OF THE DRAWINGS

Some exemplary embodiments of the invention will be described below for explaining the invention in more detail with reference to the attached Figures, in which.

DETAILED DESCRIPTION

Figure 1:
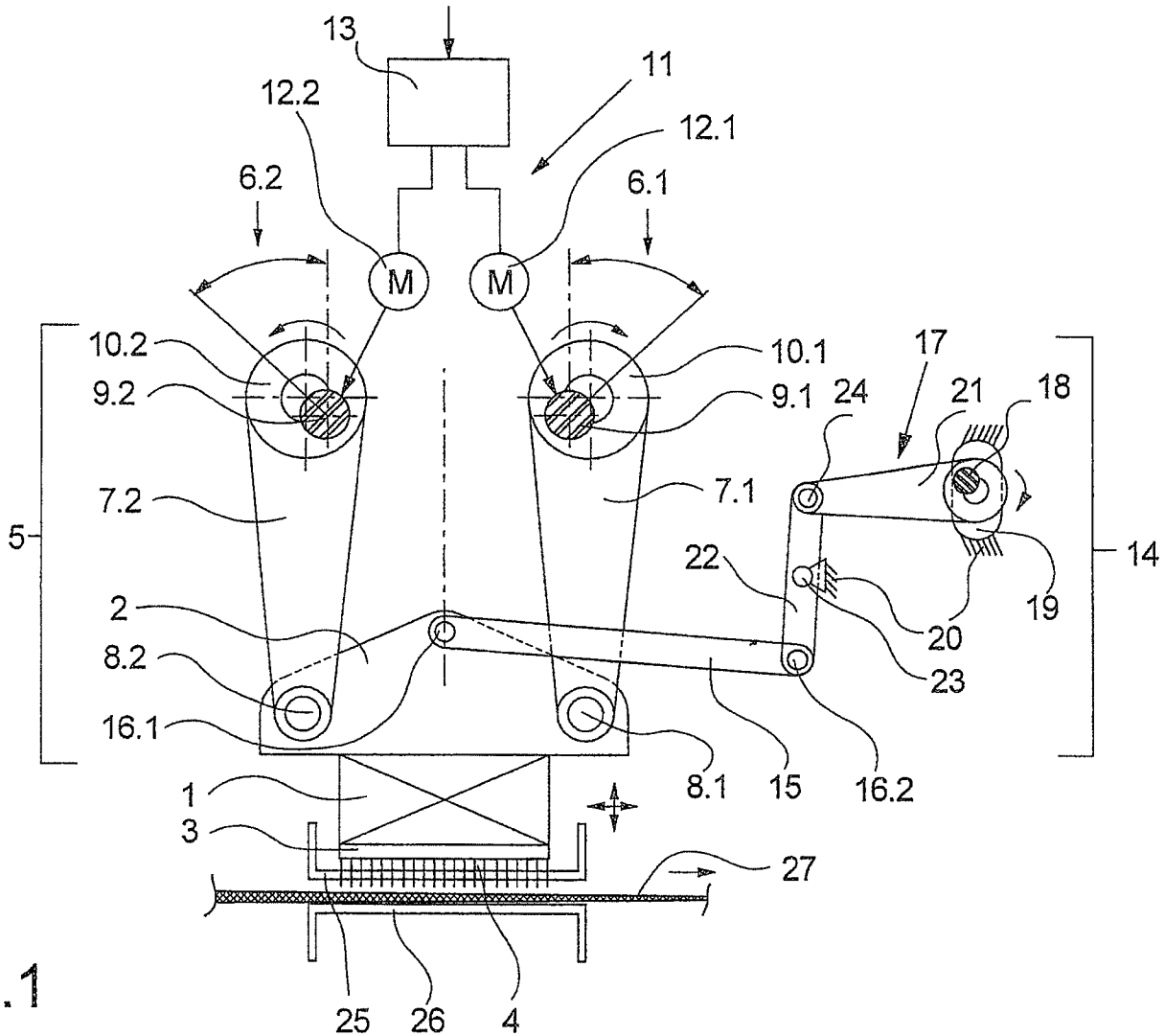
FIG. 1 schematically shows a side view of a first exemplary embodiment of the device of the invention FIG. 2 schematically shows a side view of another exemplary embodiment of the device of the invention

FIG. 1 schematically shows a first exemplary embodiment of the device of the invention for needling a fibrous web. The exemplary embodiment of the device of the invention shown in FIG. 1 shows a beam carrier 2, the lower side of which holds a needle beam 1. The lower side of the needle beam 1 comprises a needle board 3 having a plurality of needles 4. A bedplate 26 and a stripper 25 are assigned to the needle board 3 comprising the needles 4, a fibrous web 27 being guided at a substantially constant feed rate between the bedplate 26 and the stripper 25. An arrow indicates the direction of movement of the fibrous web 27.

A crank mechanism drive 5 acts upon the beam carrier 2. The crank mechanism drive 5 is formed by two crank drives 6.1 and 6.2 disposed parallel to each other. The crank drives 6.1 and 6.2 comprise two crankshafts 9.1 and 9.2, which are disposed parallel to each other above the beam carrier 2. The crankshafts 9.1 and 9.2 each comprise at least one eccentric section for receiving at least one connecting rod. FIG. 1 shows the connecting rods 7.1 and 7.2, which are disposed on the beam carrier 2 and the big ends 10.1 and 10.2 of which are held on the crankshafts 9.1 and 9.2 respectively. The opposing small ends of the connecting rods 7.1 and 7.2 are connected to the beam carrier 2 by means of two connecting swivel joints 8.1 and 8.2 respectively. The crankshaft 9.1 together with the connecting rod 7.1 and the crankshaft 9.2 together with the connecting rod 7.2 form the crank drives 6.1 and 6.2 respectively in order to guide the beam carrier 2 in an oscillating movement.

A phase-adjusting device 11 is assigned to the crankshafts 9.1 and 9.2. The phase-adjusting device comprises two actuators 12.1 and 12.2 that are assigned to the crankshafts 9.1 and 9.2. The actuators 12.1 and 12.2 are connected to a control device 13. The actuators 12.1 and 12.2 can be activated by means of the control device 13 independently of each other in order to rotate the crankshafts 9.1 and 9.2 in their bearings. A phase position between the crankshafts 9.1 and 9.2 can thus be adjusted in any desired manner. In addition to the purely vertical upward and downward movement of the needle beam 1, a superimposed horizontal movement can thus also be effected on the beam carrier 2. Thus, an approximately vertical upward and downward movement is carried out in the case of a phase balance of the crankshafts 9.1 and 9.2 and a synchronous drive of both the crankshafts. In the case of an offset in the phase positions of the crankshafts 9.1 and 9.2, the connecting rods 7.1 and 7.2 bring about an oblique positioning of the beam carrier 2, which, in the case of an advancing movement, generates a component motion that is directed in the movement direction of the fibrous web 27. The amount of phase adjustment between the crankshafts 9.1 and 9.2 is directly proportional to the stroke length of the horizontal movement. The stroke of the horizontal movement can therefore be adjusted infinitely via the angle of phase difference of the crankshafts 9.1 and 9.2.

It must be mentioned expressly at this point that the phase-adjusting device 11 could alternatively be formed by an actuator and an adjustment mechanism acting upon the crankshafts 9.1 and 9.2. In this case, it is essential to drive the crankshafts 9.1 and 9.2 such that they are offset in relation to each other by a phase angle in order to also enable a horizontal movement for needling the fibrous web in addition to the vertical movement.

For guiding the movement of the beam carrier 2, a guiding device 14 is provided that comprises, in this exemplary embodiment, a steering rod 15 connected to the beam carrier 2 by means of a first swivel joint 16.1 and to a steering transmission 17 by means of a second swivel joint 16.2. The swivel joint 16.1 is formed at the center of the beam carrier 2, the steering rod 15 being substantially oriented in the horizontal direction and being connected to the laterally disposed steering transmission 17. In this exemplary embodiment, the steering transmission 17 is formed by an eccentric shaft 18 that is held in a frame-rotary bearing 19 on a machine frame 20. The eccentric shaft 18 is connected to a free end of a rocker arm 22 by means of a connecting rod 21. The connection of the rocker arm 22 to the connecting rod is carried out by means of the swivel joint 24. In the central portion of the rocker arm 22, a rocker bearing 23 is provided, on which the rocker arm 22 is held so as to be pivotable on the machine frame 20. The steering rod 15 engages a lower free end of the rocker arm 22 by means of the swivel joint 16.2.

In this exemplary embodiment, the guiding device 14 can optionally be operated by means of an actively driven eccentric shaft 18 or a freely adjustable eccentric shaft 18. Alternatively, the eccentric shaft 18 can also be replaced by a swivel joint. However, the eccentric shaft 18 of the steering transmission 17 is preferably driven synchronously relative to the crankshafts 9.1 and 9.2 for increasing flexibility and stroke adjustments. It is thus possible to carry out a deflection of the steering rod 15 in the movement direction of the fibrous web 27, which deflection is dependent on the magnitude of eccentricity of the eccentric shaft 18. Apart from the guidance of the beam carrier 2, a superimposed constant horizontal stroke of the beam carrier can be achieved by means of the steering rod 15.

By means of a phase difference between the crankshafts 9.1 and 9.2, it is thus possible to adjust both an increase and a decrease of the horizontal stroke predefined by the guiding device. The crankshafts 9.1 and 9.2 can be driven in the same or opposite direction. When the crankshafts are driven in the same direction, the phase adjustment is carried out in the opposite direction. In contrast, when the crankshafts are driven in the opposite direction, the phase adjustment is carried out in the same direction.

Irrespective of whether the guiding device is operated by means of a driven or non-driven eccentric shaft, the translatory movements of the beam carrier 2 are guided solely by means of the rotational movement of the transmission elements of the guiding device 14. This represents a particularly cost-effective machine concept with a high degree of flexibility in terms of variable stroke adjustment in the case of superimposed vertical and horizontal movements of the beam carrier.

Figure 2:
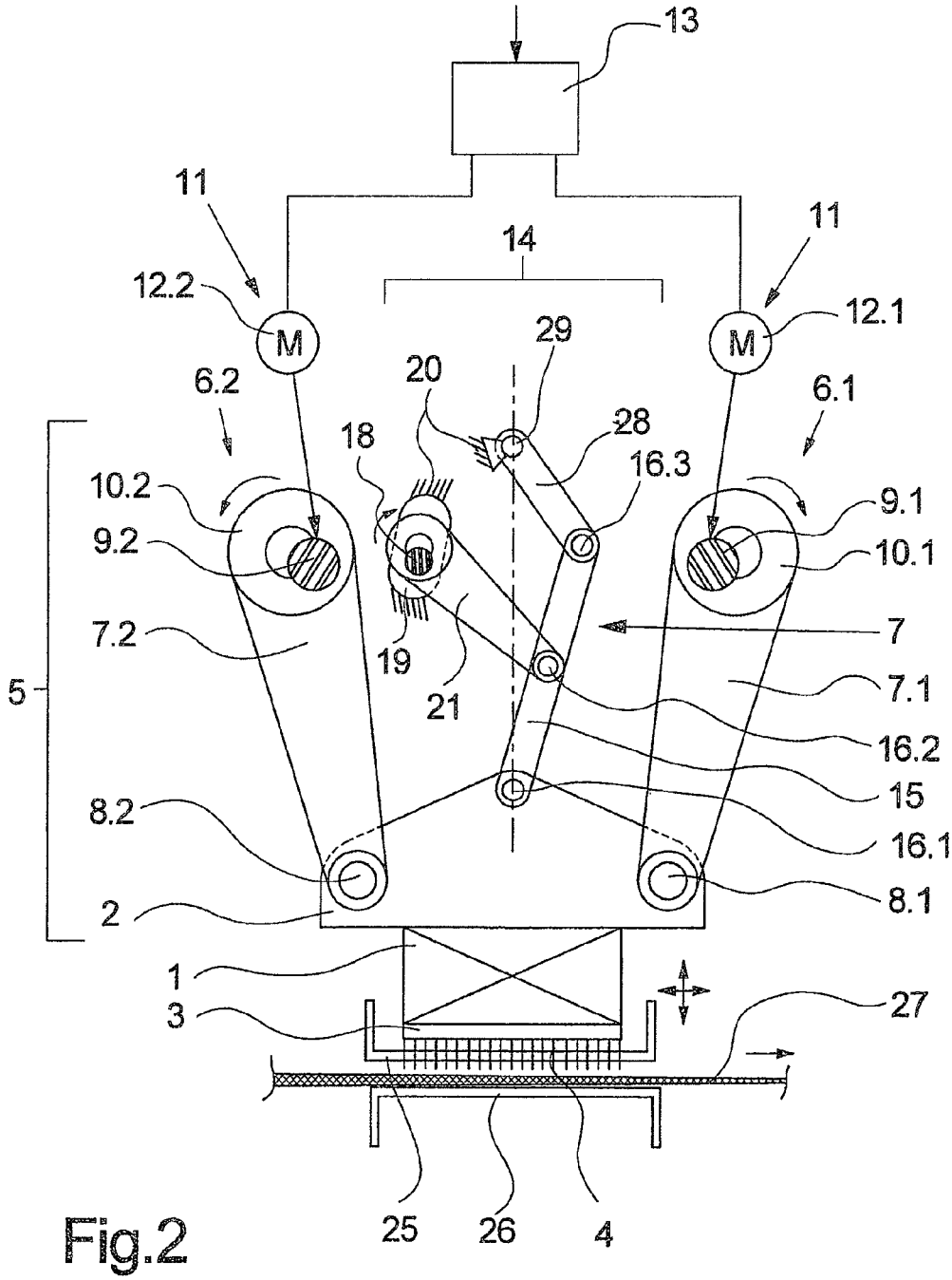

The exemplary embodiment of the device of the invention shown schematically in FIG. 2 represents an additional possibility of guiding the steering rod 15 for guiding the beam carrier 2 by means of a steering transmission 17. The exemplary embodiment shown in FIG. 2 is identical to the one cited above in terms of construction and design of the crank mechanism drive 5, the beam carrier 2 and the devices held by the beam carrier 2 so that reference is made to the above description.

As opposed to the exemplary embodiment shown in FIG. 1, the guiding device 14 in the exemplary embodiment shown in FIG. 2 is formed above the beam carrier 2 between the crank drives 6.1 and 6.2. In this exemplary embodiment, the steering transmission 17 of the guiding device 14 is formed by an eccentric shaft 18 and a rocker 28. The eccentric shaft 18 is held in the frame-rotary bearing (19) in the machine frame 20 and is coupled to a drive system (not illustrated here). A connecting rod 21 connects the eccentric shaft 18 to the steering rod 15 by means of a swivel joint 16.2. The rocker 28 is held on the machine frame 20 by means of a rotary bearing 29, and a free end thereof is coupled to the steering rod 15 by means of an additional swivel joint 16.3. When the eccentric shaft 18 is driven by a drive system synchronously to the crankshafts 9.1 and 9.2, a translatory motion is superimposed on the steering rod 15 by means of the rocker 28, and this translatory motion results in a superimposed horizontal movement of the beam carrier 2 by means of the swivel joint 16.1 with a constant horizontal stroke. The beam carrier 2 and thus the needle beam 1 carry out an elliptical movement. The rotational speed of the eccentric shaft 18 and that of the crankshafts 9.1 and 9.2 of the crank mechanism drive 5 are equal in this case so that a horizontal stroke of the needle beam can be adjusted depending on the eccentricity of the eccentric shaft 18. According to requirements, this stroke can be decreased or increased by means of a phase adjustment of the crankshafts 9.1 and 9.2.

However, it is alternatively also possible to lock the eccentric shaft 18 into position by means of the connecting rod 21 so that it would only be possible to carry out a rotational movement. In such a situation, the steering rod 15 exclusively acts upon the beam carrier 2 so as to guide the oscillating movement of the beam carrier 2.

In the exemplary embodiments of the device of the invention shown in FIGS. 1 and 2, the phase-adjusting device is represented by two actuators 12.1 and 12.2. Such a phase-adjusting device is illustrated merely by way of example. The crankshafts can be adjusted both during operation when the shafts are rotating and during the idle period when the shafts are stationary. It is thus possible to assign a mechanical or hydraulic transmission system to the crankshafts for adjustment purposes. Thus, for example, a motor or an actuator can be used for initiating the adjustment of the shafts by means of the transmission system.

The device of the invention for needling a fibrous web thus offers a high degree of flexibility for guiding and driving a needle beam. In particular, it is possible to realize flexible stroke adjustments for carrying out horizontal movements.

LIST OF REFERENCE NUMERALS

1 Needle beam
2 Beam carrier
3 Needle board
4 Needles
5 Crank mechanism drive
6.1, 6.2 Crank drive
7.1, 7.2 Connecting rods
8.1, 8.2 Connecting swivel joint
9.1, 9.2 Crankshaft
10.1, 10.2 Connecting-rod big end
11 Phase-adjusting device
12.1, 12.2 Actuator
13 Control device
14 Guiding device
15 Steering rod
16.1, 16.2, 16.3 Swivel joint
17 Steering transmission
18 Eccentric shaft
19 Frame-rotary bearing
20 Machine frame
21 Connecting rod
22 Rocker arm
23 Rocker bearing
24 Swivel joint
25 Stripper
26 Bedplate
27 Fibrous web
29 Rotary bearing

The invention claimed is:

1. A device for needling a fibrous web, said device comprising:

at least one driven needle beam, the lower side of which comprises a needle board having a plurality of needles;

at least one movable beam carrier for holding the needle beam;

a crank mechanism drive for moving the beam carrier in an oscillating manner, the crank mechanism drive comprising at least two crank drives having two driven crankshafts and a phase-adjusting device for the phase adjustment of the two crankshafts; and a guiding device acting on the beam carrier for guiding the needle beam during the oscillating movement, wherein the guiding device comprises a steering rod, one end of which is connected to the beam carrier by means of a swivel joint and the other end of which is coupled to a steering transmission by means of a second swivel joint, wherein the steering transmission comprises a plurality of transmission elements for guiding the steering rod, which transmission elements are held on a machine frame at least by means of a frame-rotary bearing, and wherein a transmission element is formed as a rocker arm, the central portion of which is held on the machine frame by means of a rocker bearing and the ends of which are connected to the steering rod and the connecting rod respectively, the connecting rod being coupled to the frame rotary bearing.

2. The device according to claim 1, wherein one of the transmission elements is formed as a drivable eccentric shaft that is mounted in the frame-rotary bearing and that is coupled to the steering rod by means of a connecting rod.

3. The device according to claim 1, wherein the beam carrier comprises a swivel joint for connecting the steering rod to the center of the beam carrier.

4. The device according to claim 1, wherein the phase-adjusting device comprises two actuators that are connected to the crankshafts of the crank drives and that can be controlled independently of each other by means of a control device.

5. The device according to any of the claim 1, wherein the phase-adjusting device is formed by a mechanical or hydraulic transmission system.

6. The device according to claim 1, wherein the crank mechanism drive comprises connecting rods, big ends of which being held on the crankshafts, respectively, and opposing smaller ends of which being connected to the beam carrier by means of a swivel joint, respectively.

7. A device for needling a fibrous web, said device comprising:

at least one driven needle beam, the lower side of which comp rises a needle board having a plurality of needles;

at least one movable beam carrier for holding the needle beam;

a crank mechanism drive for moving the beam carrier in an oscillating manner, the crank mechanism drive comprising at least two crank drives having two driven crankshafts and a phase-adjusting device for the phase adjustment of the two crankshafts; and a guiding device acting on the beam carrier for guiding the needle beam during the oscillating movement, wherein the guiding device comprises a steering rod, one end of which is connected to the beam carrier by means of a swivel joint and the other end of which is coupled to a steering transmission by means of a second swivel joint, wherein the steering transmission comprises a plurality of transmission elements for guiding the steering rod, which transmission elements are held on a machine frame at least by means of a frame-rotary bearing, and wherein the guiding device is formed above the beam carrier between the crank drives.

8. The device according to claim 7, wherein a transmission element is formed as a rocker that is connected to the machine frame by means of a rotary bearing and wherein a free end of the rocker and the connecting rod are connected in parallel to the steering rod by means of separate swivel joints.

9. The device according to claim 7, wherein one of the transmission elements is formed as a drivable eccentric shaft that is mounted in the frame-rotary bearing and that is coupled to the steering rod by means of a connecting rod.

10. The device according to claim 7, wherein the beam carrier comprises a swivel joint for connecting the steering rod to the center of the beam carrier.

11. The device according to claim 7, wherein the phase adjusting device comprises two actuators that are connected to the crankshafts of the crank drives and that can be controlled independently of each other by means of a control device.

12. The device according to any of the claim 7, wherein the phase-adjusting device is formed by a mechanical or hydraulic transmission system.

13. The device according to any of the claim 7, wherein the crank mechanism drive comprises connecting rods, big ends of which being held on the crankshafts, respectively, and opposing smaller ends of which being connected to the beam carrier by means of a swivel joint, respectively.

* * * * *

UNITED STATES PATENT AND TRADEMARK OFFICE

CERTIFICATE OF CORRECTION

PATENT NO. : 8,495,805 B2
APPLICATION NO. : 12/937841
DATED : July 30, 2013
INVENTOR(S) : Reutter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 278 days.

Signed and Sealed this
Fifteenth Day of September, 2015

Michelle K. Lee

Michelle K. Lee
*Director of the United States Patent and Trademark Office*